US010227769B2

(12) United States Patent
Catteau et al.

(10) Patent No.: US 10,227,769 B2
(45) Date of Patent: Mar. 12, 2019

(54) DEVICE AND METHOD FOR ANCHORING AN OVERHANGING ELEMENT TO A CONSTRUCTION

(71) Applicant: B&R N.V., Arendonk (BE)

(72) Inventors: Michel Catteau, Lier (BE); Luc Claeys, Lier (BE)

(73) Assignee: B&R N.V., Arendonk (BE)

( * ) Notice: Subject to any disclaimer, the term of this patent is extended or adjusted under 35 U.S.C. 154(b) by 0 days.

(21) Appl. No.: 15/120,631

(22) PCT Filed: Mar. 25, 2015

(86) PCT No.: PCT/IB2015/052182

§ 371 (c)(1),
(2) Date: Aug. 22, 2016

(87) PCT Pub. No.: WO2015/162507

PCT Pub. Date: Oct. 29, 2015

(65) Prior Publication Data

US 2017/0009441 A1 Jan. 12, 2017

(30) Foreign Application Priority Data

Apr. 22, 2014 (BE) ..... 2014/0277

(51) Int. Cl.
*E04B 1/41* (2006.01)
*E04B 1/00* (2006.01)

(52) U.S. Cl.
CPC ..... *E04B 1/0038* (2013.01); *E04B 1/003* (2013.01); *E04B 1/41* (2013.01); *E04B 2103/02* (2013.01)

(58) Field of Classification Search
CPC ..... E04B 1/215; E04B 1/003; E04B 1/0038; E04B 1/41; E02D 5/523; E04C 5/165
See application file for complete search history.

(56) References Cited

U.S. PATENT DOCUMENTS 4,781,006 A * 11/1988 Haynes ..... E04B 1/215 52/583.1
5,862,634 A * 1/1999 Berger ..... E04B 1/483 52/127.1

(Continued)

FOREIGN PATENT DOCUMENTS

| | | |
|---|---|---|
| EP | 1126091 | 8/2001 |
| NL | 1035733 | 1/2010 |

OTHER PUBLICATIONS

International Search Report for PCT/IB2015/052182, Completed by the European Patent Office dated Jun. 23, 2015, 3 Pages.

(Continued)

*Primary Examiner* — Brian E Glessner
*Assistant Examiner* — Daniel J Kenny
(74) *Attorney, Agent, or Firm* — Brooks Kushman P.C.

(57) ABSTRACT

A device and method for anchoring an overhanging element to a construction, which device includes two coupling parts, one coupling part of which is suitable to be connected to the overhanging element whereas the other one is suitable to be connected to the construction, and whereby the coupling parts are provided with mechanical coupling and whereby at least one of the coupling parts includes a freely protruding element whose maximum length is larger than ten centimetres.

5 Claims, 4 Drawing Sheets

(56) References Cited

U.S. PATENT DOCUMENTS

| | | | | |
|---|---|---|---|---|
| 6,679,017 | B2 * | 1/2004 | Woodruff, III | E04B 1/215 403/360 |
| 7,818,933 | B2 * | 10/2010 | Berg | E04B 1/215 52/250 |
| 8,950,133 | B2 * | 2/2015 | Hansort | E04B 1/215 52/283 |
| 8,973,317 | B2 * | 3/2015 | Larkin | E04B 1/7608 52/223.14 |
| 2004/0050012 | A1 * | 3/2004 | Pulkkanen | E04B 1/4121 52/702 |
| 2008/0279620 | A1 * | 11/2008 | Berg | E04B 1/215 403/178 |
| 2009/0022545 | A1 * | 1/2009 | Koivunen | E02D 5/523 403/379.4 |
| 2016/0215491 | A1 * | 7/2016 | Haughton | E04B 1/003 |

OTHER PUBLICATIONS

Search Report for Belgium Application No. BE 2014/00277, Completed by the European Patent Office dated Dec. 11, 2014, 8 Pages.

* cited by examiner

DEVICE AND METHOD FOR ANCHORING AN OVERHANGING ELEMENT TO A CONSTRUCTION

CROSS-REFERENCE TO RELATED APPLICATION

This application is the U.S. national phase of PCT Application No. PCT/IB2015/052182 filed on Mar. 25, 2015, which claims priority to BE Patent Application No. BE201400277 filed on Apr. 22, 2014, the disclosures of which are incorporated in their entirety by reference herein.

The present invention concerns a device for anchoring an overhanging element to a construction.

A common example of an overhanging element on a construction is a balcony on a building.

In the existing balconies made of concrete, the reinforcement bars of the balcony are fed into the floor slab of the corresponding floor.

In order to obtain a thermal break, anchoring systems have been developed which make it possible for the reinforcement bars to continue from the balcony floor slab to the inside floor slab of the floor concerned, whereas the concrete mass is interrupted by thermal insulation material.

On the side to be placed on top when in use, such anchoring systems are provided with tie rods, usually also with push rods and with slantingly ascending connecting rods between tie and push rods or connecting reinforcements so as to absorb the lateral forces. An insulating material is provided centrally, between the concrete plates.

Such systems are disadvantageous in that the bricklaying of the external facade cannot start until the balconies have been provided.

Finally, it should be noted that placing such balconies always requires some temporary scaffolding, which entails enormous costs.

Moreover, when not all balconies are neatly placed one above the other, as modern architecture often requires, the cost of said temporary scaffolding will be considerably increased.

The present invention aims to remedy the above-mentioned and other disadvantages of the known anchorings of an overhanging element to a construction.

To this end, the invention concerns a device for anchoring an overhanging element to a construction, which device comprises two coupling parts, one coupling part of which is suitable to be connected to the overhanging element whereas the other is suitable to be connected to the construction, and whereby the coupling parts are provided with mechanical coupling means and whereby at least one of the coupling parts comprises a freely protruding element whose maximum length is more than ten centimetres.

A major advantage consists in that the overhanging element can be connected in a safe manner from the inside of the building or building construction to this construction without the need of providing any support at the time of anchoring.

Moreover, significantly less work force will be required at the time of anchoring since the overhanging element can be supplied as prefabricated and it will suffice to make the mechanical connection, which can be entirely done on the inside of the construction.

Indeed, the minimum length of the freely protruding element allows to maintain the overhanging element in position on the outside of the construction, for example by means of a crane, whereby the freely protruding element is fed through the insulating layer into the inner space, where the mechanical coupling can be accomplished.

The present invention also concerns a method for anchoring an overhanging element to a construction, whereby during the assembly of the construction, the possible application of the insulating layer and, if necessary, the application of any facade finish, precedes the anchoring of the overhanging element to the construction.

A preferred application of this method consists in using a device according to the invention whereby one coupling part is connected to the overhanging element whereas the other coupling part is connected to the construction during its assembly, and whereby, after essentially applying the possible insulating layer and, if need be, after essentially completing the facade finish, the overhanging element is connected to the construction by mutually connecting the coupling parts by means of the mechanical coupling means.

In order to better explain the characteristics of the invention, the following preferred embodiment of a device for anchoring an overhanging element to a construction according to the invention is described by way of example only, without being limitative in any way, with reference to the accompanying figures, in which.

Figure 1:
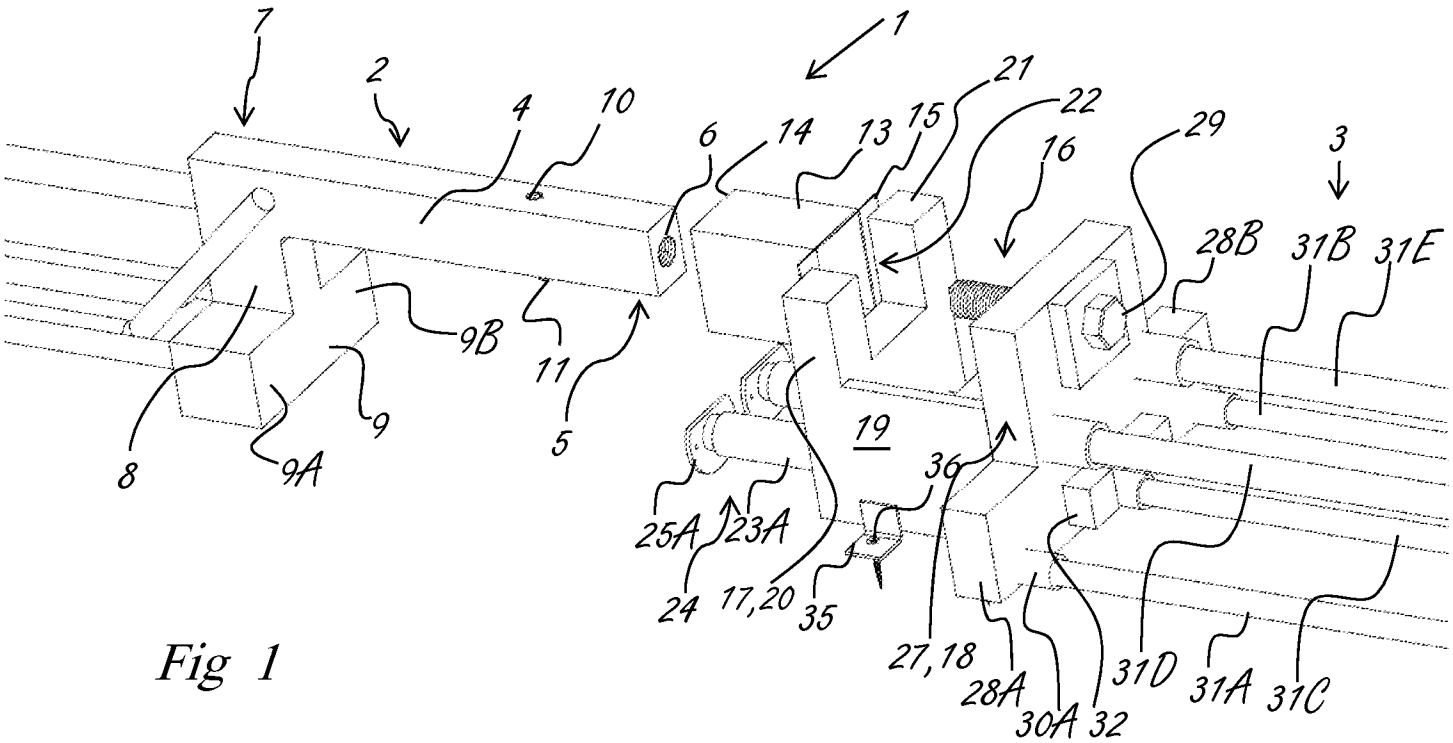
FIG. 1 shows a device for anchoring an overhanging element to a construction in exploded perspective.

FIG. 1 represents a device for anchoring an overhanging element to a construction 1 according to the invention, in short also called anchoring 1, with two coupling parts, in this case more specifically a male coupling part 2 and a female coupling part 3 shown in an exploded relative position.

The male coupling part 2 is designed here to be provided in an overhanging element such as a balcony floor, whereas the female coupling part 3 is designed here to be provided in a main structure such as a building.

The male coupling part 2 essentially consists of a substantially solid, in this case a first metal beam element 4 provided with a threaded bore 6 at one end 5 in the crosscut face, and provided with a second beam element on the opposite end 7 directed transversely to the first beam element 4 leading to a foot 9 protruding on either side of the second beam element 8 having a first foot part 9A and a second foot part 9B.

Between both ends 5 and 7 is provided a second bore 10, in this case mainly transverse to the bore 6 and parallel to the second beam element 8.

In this second bore 10 is provided a threaded pin 11.

Connected to the male coupling part 2, in particular on the side away from the first beam element 4, are provided reinforcement bars 12A-12E.

Figure 2:
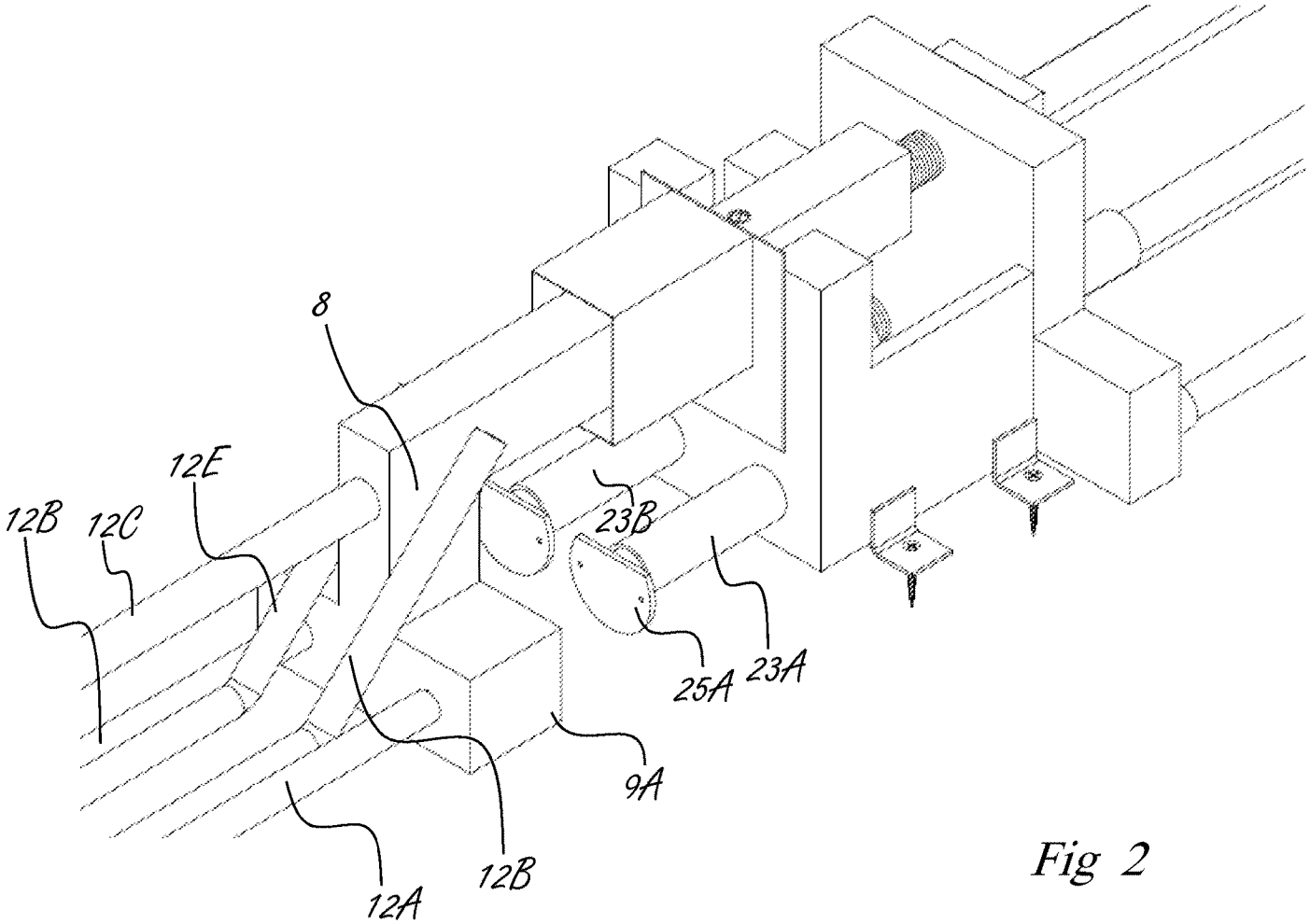
FIGS. 2 and 3 represent the device according to FIG. 1 each time from another point of view.
Figure 3:
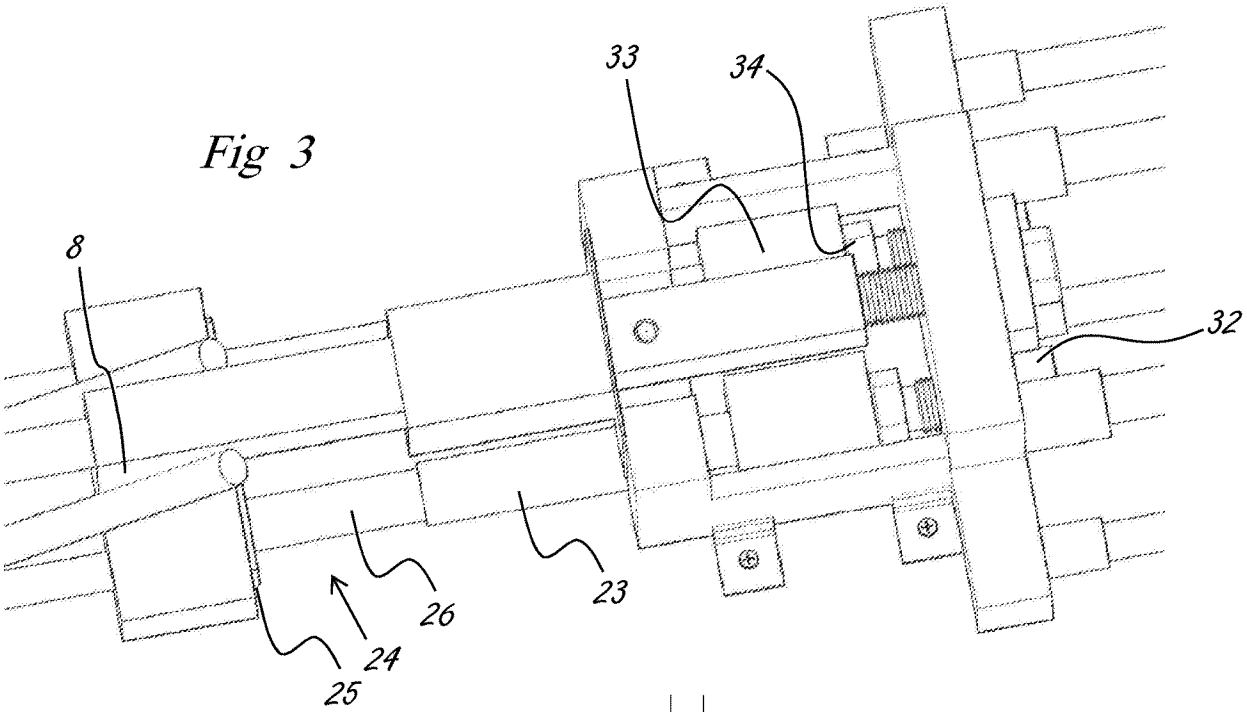

As is shown in more detail in FIG. 2, five reinforcement bars 12A to 12E are concerned here, whereby the reinforcement bars 12A and 12B are positioned in line with the first foot part 9A and second foot part 9B respectively, and whereby the reinforcement bar 12C is provided higher and in line with the first beam element 4.

The two reinforcement bars 12D and 12E are essentially provided between the reinforcement bars 12A and 12B here, but near the male coupling part 2 they evolve upward alongside the first beam element 4 of the male coupling part 2.

The female coupling part 3, designed to be provided in a main structure such as for example a building, comprises a sleeve 13 with an access opening 14 on one side.

On the other side, the sleeve 13 is provided with two laterally protruding shoulder plates 15 which are connected to a massive structure 16.

Said massive structure 16 essentially consists of an outer wall 17 and an inner wall 18 which are mutually connected by means of two side walls 19.

As for the wording, it should be noted that "outer" and "inner" refer to the position of the overhanging element situated outside the main structure.

The outer wall 17 is designed here as a substantially rectangular massive thick plate 20 in which is provided a rectangular recess 22, centrally to the edge 21 which is located at the top when in use.

The shoulder plates 15 are connected to the outer wall 17, such that the rectangular recess 22 is provided in the extension of the sleeve 13.

The outer wall 17 is, still seen in the position of use, provided with two passages at the bottom, not visibly displayed here, and in cooperation therewith with two sleeves 23 which each extend as of the outer wall 17 up to a distance thereof in the direction of the male coupling part 2.

Throughout said sleeves 23 are provided adjustable punches 24 with contact plates 25 on the side directed towards the male coupling part 2, in this case mainly with a truncated circular shape.

In the sleeves 23 and partly in the space between the outer wall 17 and the inner wall 18, the punches 24 essentially consist of rod elements 26 whose position can be adjusted.

The inner wall 18 is designed as a massive thick plate 27 as well here, provided at the bottom with a protruding shoulder 28A and 28B on either side.

The inner wall 18 is provided centrally and, when in use essentially at the top, with a bore through which a bolt 29 is fed, designed to cooperate with the bore 6 in the male coupling part 2.

On the inwardly facing side, i.e. away from the male coupling part 2, the inner wall 18 is provided with bushes 30A-30E which serve as coupling means for reinforcement bars 31A-31E.

Indeed, connected to the female coupling part 3, on the inward side of the inner wall 18, are provided reinforcement bars 31A-31E.

Two reinforcement bars 31A and 31B are concerned here, in line with the protruding shoulder 28A and 28B respectively, and centrally therebetween reinforcement bar 31C, all of them in conjunction with accompanying bushes 30A, 30B and 30C respectively.

Somewhat above and at intermediate positions are further provided two reinforcement bars 31D and 31E, in conjunction with accompanying bushes 30D and 30E.

The two side walls 19 rigidly and securely connect the outer wall 17 to the inner wall 18.

The punches 24 extend as of the contact plates 25 and through bores provided in the inner wall 18, where the punches 24 are provided with an end plate.

In the space between the side walls 19, the punches 24A and 24B in this embodiment comprise separate spacers 33A and 33B in the shape of blocks. These spacers 33A and 33B, in a mounted and activated state, are provided between the rod elements 26 on the one hand, and adjusting nuts 34A and 34B on the other hand.

On their sides directed away from one another, the side walls 19 are each provided with two coupling parts 35 with a bore 36.

The use and operation of the anchoring 1 according to the invention is simple and as follows, with reference to FIG. 4.

This is based on a main structure A which is a building A in this case, built of supporting walls 37 on which are provided prefabricated concrete vaults or wide floor boards 38.

Before pouring the so-called mixed concrete layer 39, the female coupling part 3 is put in place, either or not before the reinforcement bars 31 are provided.

Figure 4:
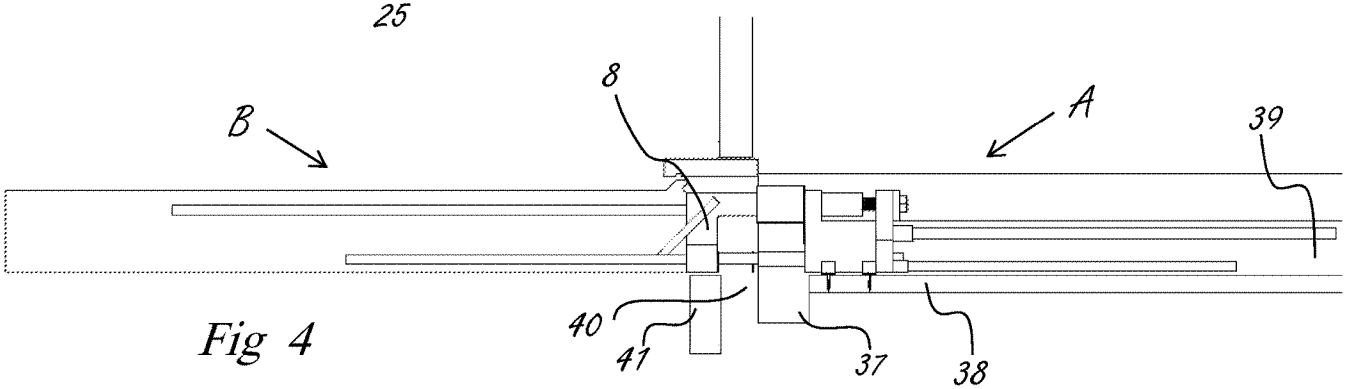
FIG. 4 represents the device according to FIG. 1 seen in side view and in the mounted position of use.

As is shown in FIG. 4, in this application, the outer wall 17 is placed with the side directed away from the inner wall 18 predominantly in line with the side of the supporting wall 37 directed to the inside of the main structure.

In other words, the female coupling part 3 is placed in such a manner that, afterwards, the further construction of the supporting wall 37 is only just not hindered.

The sleeves 23 and the punches 24 thereby extend through the supporting wall 37.

Note that, according to an alternative application, the outer wall 17 of the female coupling part 3, with its side turned away from the inner wall 18, is placed predominantly in line with the side of the supporting wall 37 which is directed to the outside of the main structure, i.e. the female coupling part 3 is then provided such that the application of the insulating layer 40 is only just not hindered.

This variant application, or intermediate placements, is advantageous in that the male coupling part 2 can be made shorter, which is beneficial to the vibration transfer.

The female coupling part 3 is connected to the floor slab 38, in this case by feeding screws through the bores 36 in the coupling parts 35 on the side walls 19.

The reinforcement bars 31 are placed in proper cooperation with the bushes 30, such that a purposeful transfer of forces is obtained.

Note that the bolt 29 is situated higher than the upper surface of the pressure layer 39.

After this, the main structure A can be built up further, and even the optional application of an insulating layer 40 and the masonry of the outer wall 41 can be carried out before applying the overhanging element B, in this case a balcony floor B, to the main structure A.

If appropriate, the overhanging element B can be supplied for example with the aid of a crane.

The overhanging element B, in this case a prefabricated balcony floor B, is provided with two male coupling parts 2 here as explained above.

The reinforcement bars 12, the second beam element 8 and the foot 9 of each male coupling part 2 are all being held in the concrete of the balcony floor B, such that a solid and durable connection is provided for between the male coupling part 2 and the balcony floor B.

The second beam element 8 and the foot 9 can be regarded as a connection basis of the male coupling part 2.

Generalizing further, the first beam element 4 can be regarded as a force transmission and the threaded bore 6 as a part of mechanical coupling means between the coupling parts 2 and 3.

Placing and mounting the balcony floor B is very simple and safe.

A crane brings the balcony floor B into a position near the female coupling parts 3 concerned, provided at an appropriate distance from one another in the main structure 1 in the manner described above.

On the inside of the main structure A are standing for example two skilled workers.

They guide the first beam elements 4 in the sleeves 13, more specifically via the access openings 14.

The first beam elements 4 reach with the bore 6 up to the bolts 29 which are screwed down.

Note that the length of the beam element 4, i.e. the distance D between the part of the male coupling part 2 incorporated in the concrete of the balcony element B, in this case the second beam element 8 and the foot 9 on the one hand, and the access opening of the bore 6 on the other hand, is such that the thickness of the outer wall 41 and of the inner wall or supporting wall 37 and the intermediate insulating layer 40 and the air cavity can be bridged, one and another in such a way that the mechanical connection within the main structure A can be established.

It is clear that in the absence of an outer wall 41 and/or of a cavity and/or in case of a more outer placement of the female coupling part 3, for example such that the outer wall 17 of the female coupling part 3, with its side moved away from the inner wall 18, is placed substantially in line with the side of the supporting wall 37 directed towards the outside of the main structure, the aforesaid distance D or length of the first beam element 4 can be restricted.

This distance D or length of the first beam element 4 of the male coupling part 2 amounts to at least the thickness of the applied insulating layer 40 plus the distance between the end face of the first beam element 4 and the support point, here embodied as a pin 11.

In practice, therefore, this distance D will amount to at least ten centimetres.

The threaded bore 6 on the one hand and the bolt 29 on the other hand are in this case the mechanical coupling means between the coupling parts 2 and 3.

The level or height of the first beam elements 4 and consequently of the balcony floor B can be adjusted by adjusting the pins 11.

The extent to which the punches 24 protrude forward can be adjusted by operating the as yet still accessible end plates 32 of the punches 24 on site.

The force distribution is such that the punches 24 are exposed to pressure and vice versa exert pressure on the foot parts 9A and 9B, whereas the bolt 29 and the first beam element 4 are subject to tensile forces and shear forces.

These forces are appropriately transferred to the reinforcement bars 12 in the balcony floor B on the one hand, and to the reinforcement bars 31 in the main structure A on the other hand.

It is clear that the mechanical coupling means provided on the male coupling part 2 and the female coupling part 3, in the given example embodied as the threaded bore 6 which can work in conjunction with the nut 29, can be alternatively embodied with other known mechanical coupling means.

Figure 5:
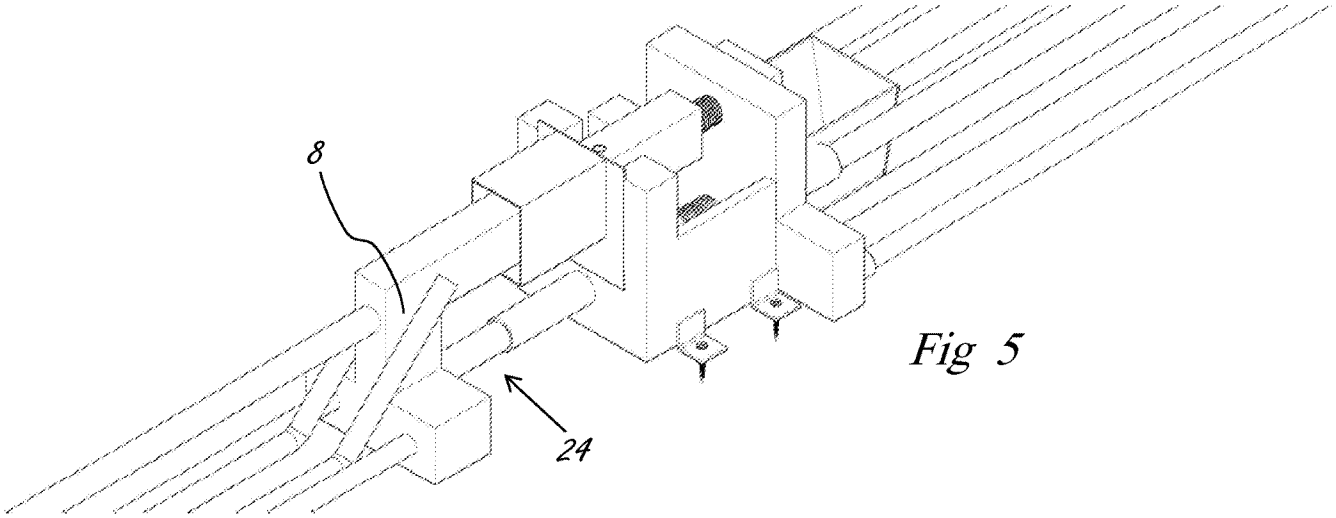
FIGS. 5 to 7 represent three different views of one and the same alternative embodiment variant of a device for anchoring an overhanging element to a construction.
Figure 7:
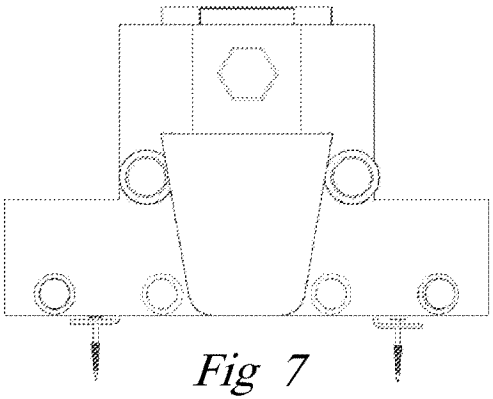
Figure 6:
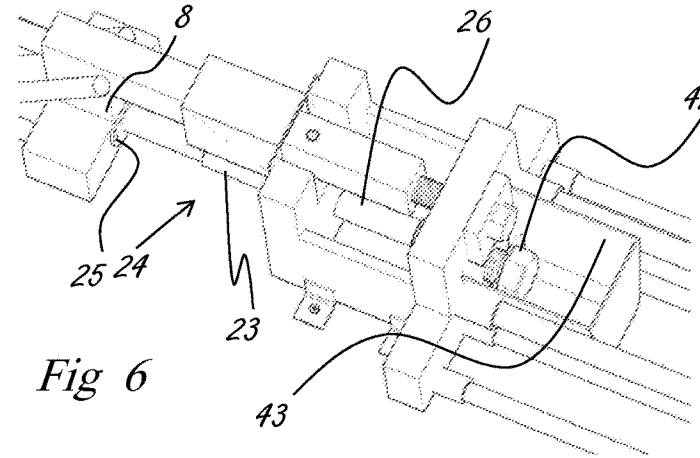

FIGS. 5 to 7 show an alternative embodiment which mainly differs from the embodiment according to FIGS. 1 to 4 in that only one adjustable punch 24 is provided, centrally in this case and under the first beam element 4.

The punch 24 is provided with one accompanying sleeve 23 through which the adjustable punch 24 is fed, with a contact plate 25 on the side directed towards the male coupling part 2, here also with a substantially truncated circular shape.

In the sleeve 23 and through the space between the outer wall 17 and the inner wall 18, the punch 24 mainly consists of a rod element 26 on the one hand whose position can be adjusted, and of a bolt 42 on the other hand.

In the space between the side walls 19, the punch 24 does not comprise a separate spacer 33 in this case, but the rod element 26 with an outer diameter of for example 32 millimetres is embodied in one piece and can be freely moved through a wider passage in the inner wall 18.

To this end, said passage has an inner diameter of for example 40 millimetres. However, this passage is also provided with internal thread.

The rod element 26 or the so-called push rod 26, when at rest, is freely fed through the passage in the plate 18 into the required position.

After the rod element 26 has been extended to the overhanging element, in this case to the male coupling part 2, a bolt 42 will be screwed in the threaded passage via the freed inside of plate 18, putting and maintaining the rod 26 under pressure.

In other words, in this embodiment, the punch 24 can be operated via the inwardly facing side of the inner wall 18.

In order to achieve the necessary displacement of the punch, enough space is provided which is delimited by the housing 43.

This variant embodiment provides a safe assembly area during the coupling of the coupling parts, i.e. the male coupling part 2 and the female coupling part 3.

It is clear that the device for anchoring an overhanging element to a construction according to the invention can be applied in a variety of construction arrangements.

In addition to fixing a balcony or the like, for example also a roof projection can be realised in this way.

It is also clear that such overhanging elements on a construction can also be realised with for example timber frame and metal constructions.

The invention is by no means restricted to the embodiment of a device for anchoring an overhanging element to a construction according to the invention described by way of example and represented in the accompanying figures; on the contrary, such a device for anchoring an overhanging element to a construction according to the invention can be made in many different ways while still remaining within the scope of the invention.

The invention claimed is:

1. A device for anchoring an overhanging element to a construction, the device comprising:

two coupling parts, a male coupling part of which is suitable to be connected to the overhanging element and a female coupling part suitable to be connected to the construction, and whereby the coupling parts are provided with mechanical coupling means and whereby the male coupling part comprises a freely protruding element whose length is longer than ten centimeters, and wherein the male coupling part consists of a first metal beam element having a crosscut face at a first end provided with a threaded bore and an opposite second end is provided with a connecting base comprising a second beam element directed transversely to the first beam element leading to a foot protruding on either side of the second beam element with a first foot part and a second foot part, whereby the length of the first beam element is at least ten centimeters.

2. The device according to claim 1, wherein between the first and second ends of the first beam element is provided a second threaded bore.

3. A device for anchoring an overhanging element to a construction, the device comprising:

two coupling parts, a male coupling part of which is suitable to be connected to the overhanging element and a female coupling part suitable to be connected to the construction, and whereby the coupling parts are provided with mechanical coupling means and whereby at least one of the coupling parts comprises a freely protruding element whose length is longer than ten centimeters, and whereby the male coupling part comprises the freely protruding element, in the shape of a first beam element, provided with mechanical coupling means on one far end and provided with a connecting basis on the opposite far end, and wherein the female coupling part is provided with mechanical coupling means which can work in conjunction with the mechanical coupling means provided on the free ends of the protruding element, and with one or several punches which can work in conjunction with the connecting basis provided on the opposite far end of the protruding element.

4. The device according to claim 3, wherein the device comprises a structure which is formed of an outer wall and an inner wall which are mutually connected by means of two side walls, whereby, the outer wall is provided with a recess near the upper edge and is provided with at least one passage at the bottom through which a punch is or can be provided, and whereby the inner wall is provided on either side at the bottom with a protruding shoulder and is centrally located, predominantly at the top, with a bore for feeding a bolt.

5. The device according to claim 4, wherein, in cooperation with a passage in the outer wall, a sleeve is provided through which a punch can be fed, whereby in the space between the outer wall and the inner wall, the punch is formed of a rod element.

* * * * *